US009273375B2

(12) United States Patent
Li et al.

(10) Patent No.: US 9,273,375 B2
(45) Date of Patent: Mar. 1, 2016

(54) NANOMATERIAL-BASED METHODS AND APPARATUSES

(75) Inventors: Xiaochun Li, Madison, WI (US); Lianyi Chen, Madison, WI (US); Hongseok Choi, Madison, WI (US); Jiaquan Xu, Madison, WI (US)

(73) Assignee: Wisconsin Alumni Research Foundation, Madison, WI (US)

( * ) Notice: Subject to any disclaimer, the term of this patent is extended or adjusted under 35 U.S.C. 154(b) by 324 days.

(21) Appl. No.: 13/418,225

(22) Filed: Mar. 12, 2012

(65) Prior Publication Data

US 2013/0236352 A1 Sep. 12, 2013

(51) Int. Cl.

| | |
|---|---|
| ***B22F 1/00*** | (2006.01) |
| ***C22B 9/00*** | (2006.01) |
| ***C22C 1/10*** | (2006.01) |
| ***C22C 32/00*** | (2006.01) |
| *B22D 19/14* | (2006.01) |
| *C01B 35/04* | (2006.01) |
| *B05D 3/12* | (2006.01) |

(52) U.S. Cl.
CPC ..... *C22B 9/00* (2013.01); *C22C 1/1036* (2013.01); *C22C 32/0036* (2013.01)

(58) Field of Classification Search
CPC ..... B22D 25/00; B22F 3/02
USPC ..... 75/342; 164/97; 420/591; 427/292
See application file for complete search history.

(56) References Cited

U.S. PATENT DOCUMENTS 3,678,988 A * 7/1972 Tien et al. ..... 164/501
5,228,494 A * 7/1993 Rohatgi ..... 164/97
5,305,817 A * 4/1994 Borisov et al. ..... 164/97
6,253,831 B1 * 7/2001 Genma et al. ..... 164/499
7,509,993 B1 * 3/2009 Turng et al. ..... 164/97
2008/0127777 A1 * 6/2008 Motegi et al. ..... 75/342

OTHER PUBLICATIONS

Nie et al. "Microstructure and mechanical properties of SiC nanoparticles reinforced magnesium matrix composites fabricated by ultrasonic vibration." Materials Science and Engineering A 528 (2011) 5278-5282.*

Wang et al. "Microstructure and tensile properties of micro-SiC particles reinforced magnesium matrix composites produced by semisolid stirring assisted ultrasonic vibration." Materials Science and Engineering: A vol. 528, Issues 29-30, Nov. 15, 2011, pp. 8709-8714.*

L. Y. Chen et al. "Uniform Dispersion of Nanoparticles in Metal Matrix Nanocomposites." Suppl. Proceedings: Materials Processing and Interfaces, vol. 1. (May 18, 2012).

L. Y. Chen et al. "Novel Nanoprocessing Route for Bulk Graphene Nanoplatelets Reinforced Metal Matrix Nanocomposites." Scripta Materialia, vol. 57(1), p. 29-32 (Jul. 2012).

(Continued)

*Primary Examiner* — Kaj K Olsen
*Assistant Examiner* — Alexander Polyansky
(74) *Attorney, Agent, or Firm* — Crawford Maunu PLLC

(57) ABSTRACT

Nanomaterials are incorporated within a material, such as within a metal-based material. As may be implemented in accordance with various embodiments, nanomaterials are introduced to a metal-based material in a liquid state, and the metal-based material and nanomaterials are cooled from the liquid state to a viscous state. The metal-based material is stirred in the viscous state to disperse the nanomaterials therein, and the metal-based material is used in the viscous state to maintain dispersion of the nanomaterials as the metal-based material cools.

19 Claims, 12 Drawing Sheets

(56) References Cited

OTHER PUBLICATIONS

I.A. Ibrahim, F.A. Mohamed, and E.J. Lavernia, "Particulate Reinforced Metal Matrix Composites—A Review," *Journal of Materials Science*, 26 (1991), 1137-1156.
A. Kelly, "Composites in Context," *Composites Science and Technology*, 23 (1985), 171-199.
A. Mortensen and I. Jin, "Solidification Processing of Metal Matrix Composites," *International Materials Reviews*, 37 (1992), 101-128.
A. Mortensen and J. Llorca, "Metal Matrix Composites," *Annual Review of Materials Research*, 40 (2010), 243-270.
S.C. Tjong, "Novel nanoparticle-reinforced metal matrix composites with enhanced mechanical properties," *Advanced Engineering Materials*, 9 (2007), 639-652.
S.C. Tjong and Z.Y. Ma, "Microstructural and mechanical characteristics of in situ metal matrix composites," *Materials Science & Engineering R-Reports*, 29 (2000), 49-113.
D.J. Lloyd, "Particle-Reinforced Aluminum and Magnesium Matrix Composites," *International Materials Reviews*, 39 (1994), 1-23.
D.J. Lloyd, "Aspects of Fracture in Particulate Reinforced Metal Matrix Composites," *Acta Metallurgica Et Materialia*, 39 (1991), 59-71.
H.J. Gao, B.H. Ji, I.L. Jager, E. Arzt, and P. Fratzl, "Materials become insensitive to flaws at nanoscale: Lessons from nature," *Proceedings of the National Academy of Sciences of the United States of America*, 100 (2003), 5597-5600.
Z. Zhang and D.L. Chen, "Consideration of Orowan strengthening effect in particulate-reinforced metal matrix nanocomposites: A model for predicting their yield strength," *Scripta Materialia*, 54 (2006), 1321-1326.
K.S. Tun and M. Gupta, "Improving mechanical properties of magnesium using nano-yttria reinforcement and microwave assisted powder metallurgy method," *Composites Science and Technology*, 67 (2007), 2657-2664.
S. Valdez, B. Campillo, R. Perez, L. Martinez, and A. Garcia, "Synthesis and microstructural characterization of Al—Mg alloy-SiC particle composite," *Materials Letters*, 62 (2008), 2623-2625.
M. Goken and H.W. Hoppel!, "Tailoring Nanostructured, Graded, and Particle-Reinforced Al Laminates by Accumulative Roll Bonding," *Advanced Materials*, 23 (2011), 2663-2668.
X.C. Li, Y. Yang, and X.D. Cheng, "Ultrasonic-assisted fabrication of metal matrix nanocomposites," *Journal of Materials Science*, 39 (2004), 3211-3212.
Y. Yang, J. Lan, and X.C. Li, "Study on bulk aluminum matrix nano-composite fabricated by ultrasonic dispersion of nano-sized SiC particles in molten aluminum alloy," *Materials Science and Engineering A—Structural Materials Properties Microstructure and Processing*, 380 (2004), 378-383.
Y.M. Youssef, R.J. Dashwood, and P.D. Lee, "Effect of clustering on particle pushing and solidification behaviour in TiB2 reinforced aluminium PMMCs," *Composites Part A—Applied Science and Manufacturing*, 36 (2005), 747-763.
R.S. Mishra and Z.Y. Ma, "Friction stir welding and processing," *Materials Science & Engineering R-Reports*, 50 (2005), 1-78.
Z.Y. Ma, "Friction stir processing technology: A review," *Metallurgical and Materials Transactions A—Physical Metallurgy and Materials Science*, 39A (2008), 642-658.
R.S. Mishra, Z.Y. Ma, and I. Charit, "Friction stir processing: a novel technique for fabrication of surface composite," *Materials Science and Engineering a—Structural Materials Properties Microstructure and Processing*, 341 (2003), 307-310.
Y. Morisada, H. Fujii, T. Nagaoka, and M. Fukusumi, "MWCNTs/AZ31 surface composites fabricated by friction stir processing," *Materials Science and Engineering A—Structural Materials Properties Microstructure and Processing*, 419 (2006), 344-348.
H. Choi, M. Jones, H. Konishi, and X.C. Li, "Effect of combined addition of Cu and aluminum oxide nanoparticles on mechanical properties and microstructure of Al—7Si—0.3Mg alloy," *Metallurgical and Materials Transactions A—Physical Metallurgy and Materials Science*, DOI:10.1007/s11661-011-0905-7 (2011).
A. K. Geim, K. S. Novoselov, *Nat. Mater.* 2007, 6, 183.
V. Singh, D. Joung, L. Zhai, S. Das, S. I. Khondaker, S. Seal, *Prog. Mater. Sci.* 2011, 56, 1178.
S. Stankovich, D. A. Dikin, G. H. B. Dommett, K. M. Kohlhaas, E. J. Zimney, E. A. Stach, R. D. Piner, S. T. Nguyen, R. S. Ruoff, *Nature* 2006, 442, 282.
T. Kuilla, S. Bhadra, D. H. Yao, N. H. Kim, S. Bose, J. H. Lee, *Prog. Polym. Sci.* 2010, 35, 1350.
E. B. Flint, K. S. Suslick, *Science* 1991, 253, 1397.
K. S. Suslick, G. J. Price, *Annu. Rev. Mater. Sci.* 1999, 29, 295.
C. J. Lee, J. C. Huang, P. J. Hsieh, *Scripta Mater.* 2006, 54, 1415.
S. I. Cha, K. T. Kim, S. N. Arshad, C. B. Mo, S. H. Hong, *Adv. Mater.* 2005, 17, 1377.
H. Dieringa, *J. Mater. Sci.* 2011, 46, 289.
C. S. Goh, J. Wei, L. C. Lee, A. Gupta, *Mater. Sci. Eng., A* 2006, 423, 153.
S. F. Hassan, M. Gupta, *Metall. Mater. Trans. A* 2005, 36A, 2253.
J. Lan, Y. Yang, X. C. Li, *Mater. Sci. Eng., A* 2004, 386, 284.
V. Randle, *Mater. Sci. Technol.* 2010, 26, 253.
T. Watanabe, *J. Mater. Sci.* 2011, 46, 4095.
J. S. Bunch, S. S. Verbridge, J. S. Alden, A. M. van der Zande, J. M. Parpia, H. G. Craighead, P. L. McEuen, *Nano Lett.* 2008, 8, 2458.

* cited by examiner

NANOMATERIAL-BASED METHODS AND APPARATUSES

FEDERALLY SPONSORED RESEARCH OR DEVELOPMENT

This invention was made with government support under 70NANB10H003 awarded by NIST. The government has certain rights in the invention.

FIELD

Aspects of the present invention relate generally to nanomaterial-based composites, and more specifically, to materials and methods involving the incorporation of nanomaterials to form metal-type composites.

BACKGROUND

Material properties such as strength and ductility are important for a multitude of applications. One approach to enhancing the properties of metal-based materials involves the introduction of additional materials to metal. Recently, very small particles having dimensions in the nanometer scale have been introduced to metal-based materials.

While nanometer-scale materials ("nanomaterials") such as nanoparticles and nanoplatelets can be useful in a variety of applications, such nanomaterials often align to grain boundaries or gather in clusters, which can limit the ability to enhance various properties of metal-based materials. For example, incorporating nanoplatelets such as graphene sheets into metal alloys can be difficult due to large surface areas, thin sheet geometry and high surface energy, which can lead to agglomerations. Moreover, nanomaterials are difficult to handle, as they tend to float to the surface of the molten metal and/or agglomerate, such that the nanomaterials do not stay dispersed in the metal. Accordingly, nanocomposite materials (e.g., a matrix to which nanomaterials have been added to improve one or more material properties) are challenging to produce in large, industrial size quantities.

These and other problems have been challenging to a variety of materials, and to methods for making those materials.

SUMMARY

Various aspects of the present invention are directed to materials and methods involving the incorporation of nanomaterials into metal-based materials.

In accordance with various embodiments, nanomaterials such as nanoparticles and/or nanoplatelets are dispersed within a metal-based material via stirring of the material in a partially-solidified state. Viscous characteristics of the metal-based material are used to maintain the nanomaterials in a dispersed arrangement.

In various embodiments, stirring as discussed above is effected during processing as a metal-based material cools from a liquid state to a solid state, such as in an extrusion process that begins with molten metal. This approach can be carried out such that heat within the extruded metal is sufficient to facilitate stirring of the partially-solidified material (e.g., prolonging tool life), with the heat being low enough such that the extruded metal is sufficiently viscous to maintain the dispersion of the nanomaterials. In certain embodiments, ultrasonic or mechanical stirring is used to initially disperse the nanomaterials within the molten metal, with subsequent stirring in the partially-solidified state breaking up clusters or other agglomerations of the nanomaterials (e.g., as may occur while the material is still in a molten state and/or begins to cool).

In accordance with another example embodiment, nanomaterials are introduced to a metal-based material in a liquid state, and the metal-based material with nanomaterials therein are cooled from the liquid state to a viscous state (e.g., at or near a solidous temperature). The metal-based material is stirred in the viscous state to disperse the nanomaterials therein, and the metal-based material is used to maintain dispersion of the nanomaterials as the metal-based material cools. In some implementations, the metal-based material is provided in the viscous state by heating the material with an external source to the viscous state, prior to stirring.

Another example embodiment is directed to an article of manufacture including a metal-based material in a viscous state, and a plurality of nanomaterials dispersed throughout a grain structure of the metal-based material. The viscous state is a state at which the metal-based material is above its solidous temperature and at least a portion of the metal-based material is in a liquid state. In the viscous state, the metal-based material prevents substantially all of the dispersed nanomaterials from reclustering.

The above summary is not intended to describe each embodiment or every implementation of the present invention. The figures and detailed description that follow more particularly exemplify various embodiments.

DESCRIPTION OF THE FIGURES

Aspects of the invention may be more completely understood in consideration of the following detailed description of various embodiments in connection with the accompanying drawings, in which.

Figure 1:
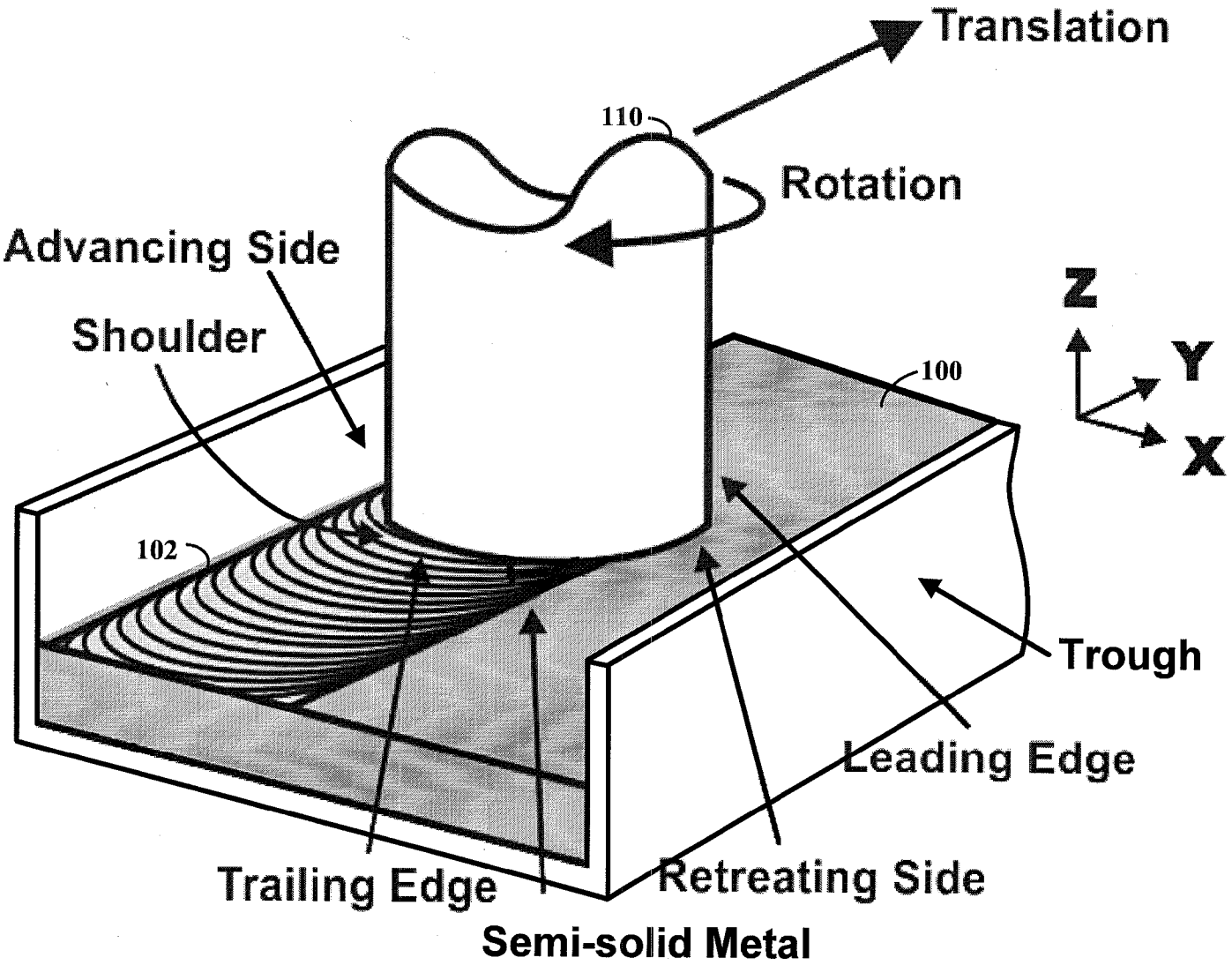
FIG. 1 shows a metal-based material with integrated nanomaterials, and a related method, in accordance with an example embodiment of the present invention.

While various embodiments of the invention are amenable to modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the scope of the invention including aspects defined in the claims.

DETAILED DESCRIPTION

Various aspects of the present invention are directed to nanomaterial-based materials and to related approaches involving the incorporation of nanomaterials in such materials, and to addressing related problems. While the present invention is not necessarily limited to such approaches, various aspects of the invention may be appreciated through a discussion of examples using this context.

In connection with various example embodiments, mechanical stirring is carried out to mix a metal-based material, and can be used to disperse nanomaterials, such as nanoparticles, nanofibers or nanoplatelets (e.g., graphene sheets) within a viscous metal-based material, using viscous characteristics of the metal-based material to maintain dispersion of the nanomaterials. Such a viscous state refers to a state occurring while the metal-based material cools from a liquid (molten) state at or above the melting temperature of the metal-based material, to a solid state below the melting temperature. Relative to the liquid state, the viscous state exhibits a higher viscosity, yet facilitates mechanical stirring relative, for example, to a solid state.

In connection with various example embodiments, it has been discovered that mechanical stirring at such an elevated material temperature facilitates dispersion yet utilizes viscous characteristics of the metal-based material to mitigate recombination/clustering with relatively low tool wear. If implemented during processing from a molten to solid state (e.g., during extrusion), these approaches can further be effected without adding heating energy via external heating and/or via friction stirring. The resulting dispersed (e.g., uniformly) nanomaterials can be used to greatly enhance mechanical properties of the resulting nanomaterials-metal composite material, such as may relate to enhanced interfacial bonding between the nanomaterials and the resulting metal matrix (e.g., metal matrix nanocomposite (MMNC)).

In a more particular example embodiment, a metal is heated above its liquidus temperature and is vibrated via ultrasonic processing. Once the metal is in a molten state, nanomaterials are fed into the molten metal during the ultrasonic processing. For example, ultrasonic processing may be used to disperse nanomaterials into molten metals using transient cavitation (with temperatures of about 5000° C., pressures of about 1000 atm) and acoustic streaming to incorporate and disperse the nanomaterials in the liquid state. The metal-nanomaterial mixture is cast into a plate, and at least a portion of the (partially cooled) plate is stirred using a rotating tool while the material is in a viscous (semi-solid) state. Multiple tools can be used, as can various tool types. In addition, these approaches can be implemented in continuous casting applications. Further processing may be carried out to provide the resulting material in sheet and/or ingot form. The figures and examples below further characterize such applications/embodiments.

As discussed above, a variety of nanomaterials such as carbon-based materials, ceramic materials and others can be dispersed in a variety of different metals and metal matrixes using approaches as described herein. Stirring of a the metal-nanomaterial combination in a viscous state facilitates the dispersion of ones of the nanoparticles that have been pushed together (e.g., by a solidification front due to repulsive Van der Waals forces between the nanoparticles and the solidification front). These approaches can be used to achieve stress-strain characteristics including yield strength, ultimate tensile strength, and elongation as relative to enhanced strength and ductility.

In one particular implementation, aluminum-based and titanium-based alloys (e.g., Al 206 with alumina ($Al_2O_3$) nanomaterials having a size of about 100-200 nm, or Al with graphene particles) can be cast using dispersion approaches discussed herein. The alpha $Al_2O_3$ can be dispersed into the Al 206 using liquid state ultrasonic processing, therein forming a liquid-state composite mixture. The $Al_2O_3$ nanomaterials may be fed, for example, into a melt of Al 206 with a double-capsulate feeding method and subsequently (initially) dispersed by ultrasonic processing.

Other approaches involve using magnesium as a metal matrix into which graphene nanoplatelets are dispersed, to form a reinforced Mg-based MMNC. Such nanoplatelets may, for example, be about 10-20 nm thick with x and y dimensions of less than about 14 μm. For instance, an automatic feeding system (feed-screw-based) can be used to feed graphene nanoplatelets into a Mg melt at about 700° C. under ultrasonic cavitation generated by a high power ultrasonic probe. After feeding, the graphene nanoplatelets are further dispersed by ultrasonic processing for 15 minutes or more. The melt with graphene nanoplatelets is then cast into a plate-like viscous mold (e.g., placed in a mold/trough that holds the melt in place), to form a Mg plate (e.g., at a thickness of 6 mm) reinforced with graphene nanoplatelets, in a viscous state.

Once in a viscous state, the metal mixture/matrix, as discussed in the examples above is stirred. The liquid-state mixture is then allowed to cool to a viscous state, above or at about a solidous temperature of the mixture. At such a condition, the mixture is stirred using a stirring tool in accordance with one or more approaches as discussed herein, with the heat in the mixture being substantially independent or independent from any friction-based heating via the stirring tool. Accordingly, energy from the tool is predominantly mechanical stirring, with generally little or insubstantial heating of the mixture being introduced via the stirring. In one implementation, a rotating pin with a diameter of about 5 mm and a length of about the thickness of the plate is inserted into the plate and traversed from side to side of the plate, using a rotating speed of about 1800 rpm and travel speed of 25 mm/min. This stirs the nanoplatelets along the travelling path in a viscous state to disperse the nanoplatelets in the Mg matrix. In one such example, Mg-based nanocomposites are reinforced with 1.2 vol. % graphene nanoplatelets to achieve a microhardness of about 66 kg/mm2 (e.g., 78% higher than the hardness of pure Mg prepared under the same condition (37 kg/mm2)).

Another example embodiment is directed to a method of forming a metal-based structure. Nanomaterials are introduced to a metal-based material in a liquid state, and the metal-based material with nanomaterials therein are provided in a viscous state at which the metal-based material is above its solidous temperature and at least a portion of the metal-based material is in a liquid state. This approach may involve, for example, cooling the metal-based material from a liquid state (e.g., during a casting process) to a solid state (e.g., at room temperature), with the viscous state being between the liquid and solid state as relative to temperature of the metal-based material. This approach may also involve, for example, heating the metal-based material after it has cooled from the liquid state to a solid state (e.g., at room temperature), to the viscous state. In the viscous state, the metal-based material is stirred in the viscous state to disperse the nanomaterials therein. These approaches can be carried out to stir the metal-based material while providing substantially no friction-based heating of the metal-based material via the stirring (i.e., the viscous state is provided via heating from a source predominantly other than any friction based heating from the stirring).

Various other embodiments are directed to an article of manufacture at a state of manufacturing as discussed herein. In one particular embodiment, an article of manufacture includes a metal-based material in a viscous state at which the metal-based material is above its solidous temperature, and at which a portion of the metal-based material is in a liquid state. The metal-based material includes a plurality of nanomaterials dispersed throughout a grain structure of the metal-based material. The metal-based material is configured and arranged to prevent substantially all of the dispersed nanomaterials from reclustering.

In certain embodiments, friction from the stirring of the partially-solidified material is also used to heat the material, which facilitates the dispersion of the nanomaterials therein. This approach involves at least some solid-state deformation of the partially-solidified material, while also using partially solidified state characteristics of the metal-based material to facilitate the dispersion of the nanomaterials. This approach can be carried out, for example, by cooling a metal mixture to at or slightly below its solidous temperature, using heat within the material but also adding some heat via the stirring.

Certain embodiments are directed to stirring a metal-based material at a partially-solidified state during solidification from a molten state to a solid state. The stirring is carried out at an elevated temperature, such as described hereinabove, and without necessarily adding nanomaterials to the metal-based material. With this approach, the resulting material (as solidified upon further cooling) exhibits desirable characteristics corresponding to the stirring of the material, while mitigating tool wear issues as may be relevant to stirring solid metal (e.g., at room temperature). In addition, various embodiments are directed to incorporating nanomaterials such as graphene nanoplatelets into a metal matrix to set or control diffusion in metals, such as for tuning one or more of creep, grain coarsening, and corrosion resistance of metals.

The materials as described herein can be implemented in one or more of a variety of applications. In some embodiments, extruded metal is manufactured and used for power-line applications. Nanomaterials mixed within a molten metal are dispersed as the metal is extruded into power lines as the extruded metal cools, using a stirring process as discussed to disperse the nanomaterials while also using viscous characteristics of the power lines to mitigate recombination (e.g., clustering) of the nanomaterials. The resulting power lines are implemented without necessarily wrapping or otherwise supporting the power lines with additional materials, as facilitated via increased strength therein as provided by the nanomaterials mixture.

In other embodiments, a resulting metal-nanomaterial matrix is used in one or more of battery applications, aluminum applications, solder and bearings. For instance, dispersed nanomaterials can lubricate bearings, which help to disperse nanomaterials that are difficult to disperse under liquid (low viscosity) conditions.

Turning now to the figures, FIG. 1 shows a metal-based material 100 with integrated nanomaterials, undergoing processing in accordance with another example embodiment of the present invention. The material 100 is brought to a viscous state, such as by allowing the material to cool from a liquidus state (e.g., as the material is being cast) to a semi-solid state (about at or above the materials solidous temperature) or by heating the material with an external heat source. In the viscous state, the material 100 is stirred using a rotating tool 110 engaged with the material, is traversed across the material 100 as shown via the arrows and respective leading edge and trailing edge of the tool, forming a stirred region 102 in which nanomaterials are dispersed. The rotating tool 110 is shown generally as a cylindrical tool, and may be implemented with a variety of different shapes to suit different applications, some of which shapes are shown in other figures and discussed herein. The mixing is effected in the viscous state, under which the material 100 exhibits viscous characteristics that maintain the nanomaterials in a dispersed arrangement (mitigating/preventing the nanomaterials from clustering). Accordingly, the rotating tool 110 can be implemented without a shoulder, as a pin or stirring blades that engage with the material 100 as it is in the viscous state.

Various parameters as used in the dispersion may vary, depending upon the application. For example, the direction of rotation is shown by way of example as rotating clockwise with respect to an upper surface of the material 100, with advancing and retreating sides as shown. However, the tool 110 can be traversed in one or more directions and/or with non-linear motions throughout the material 100, to suit particular applications. In addition, a variety of metal-based materials can be used for the material 100, and a variety of nanomaterials can be dispersed therein.

As discussed above, the material 100 can be heated as part of a fabrication process, in which the heat of the process is used to set the viscous state of the material as it cools from a liquidous state to a solid state, with the stirring being effected in a viscous state in which the heat in the material is predominantly independent from the stirring. Other approaches to heating involve the use of an external heating source to bring and/or hold the material 100 above or near its solidous temperature.

Figure 2:
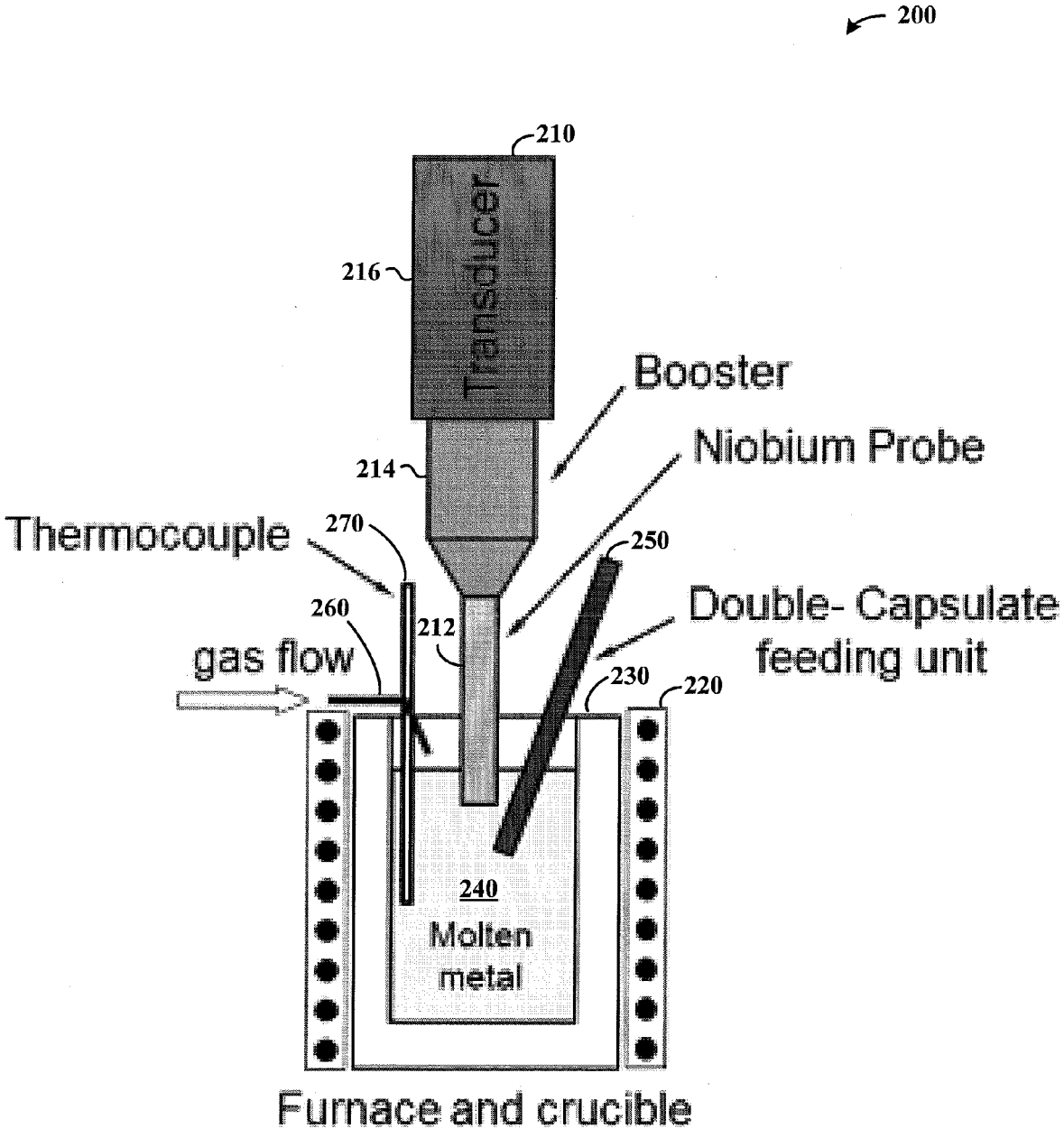
FIG. 2 shows a mixing apparatus, in accordance with another example embodiment of the present invention.
Figure 3:
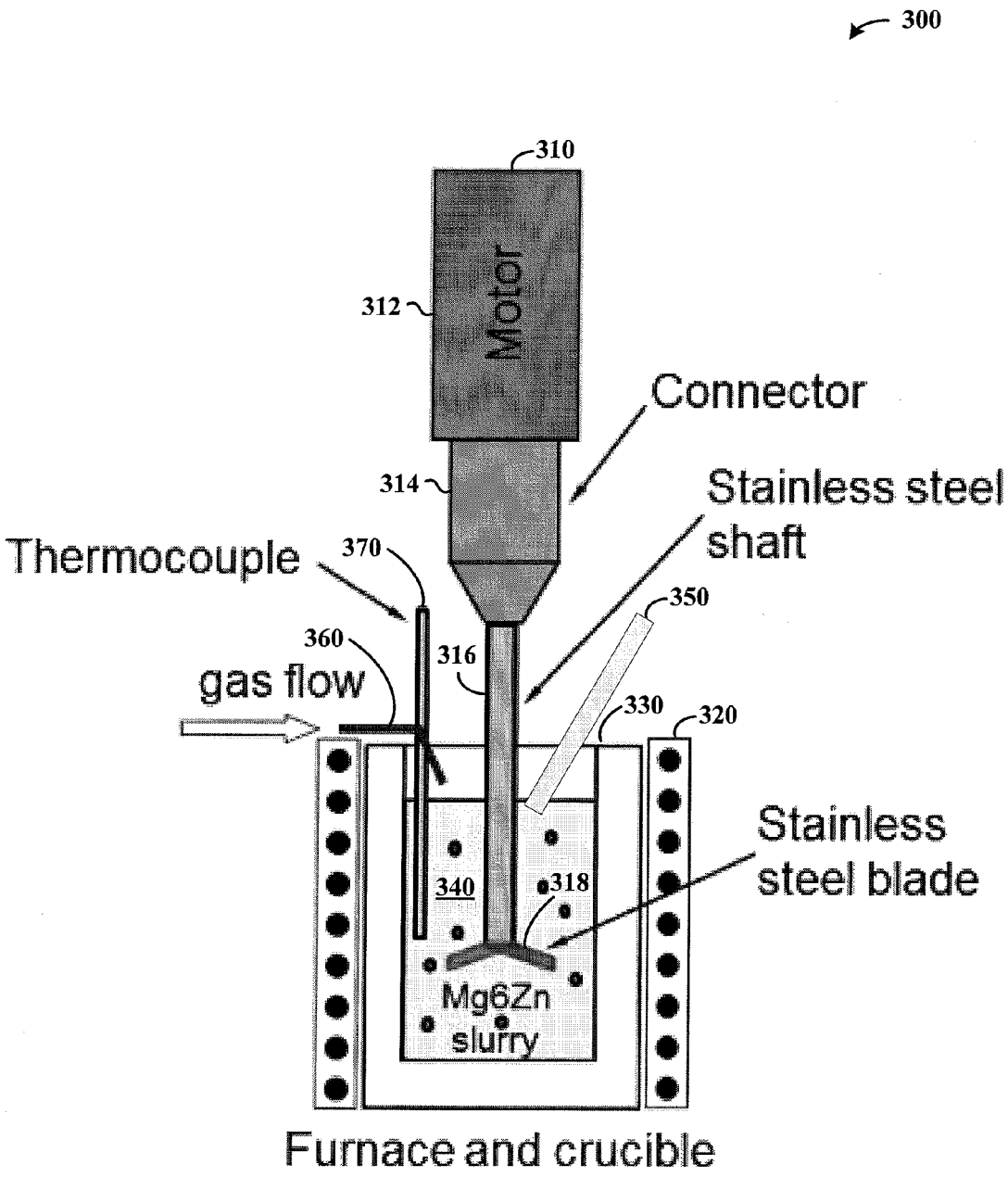
FIG. 3 shows a mixing apparatus, in accordance with another example embodiment of the present invention.

FIGS. 2 and 3 respectively show liquid-state processing apparatuses 200 and 300 that can be implemented independently and/or as part of a system/approach for fabricating the material 100. Referring to FIG. 2, the apparatus 200 includes an ultrasonic processing system 210, a resistance heating furnace 220 and a crucible 230 in which a molten metal 240 is heated. A nanomaterial feeding tube 250 is arranged to feed nanomaterials (e.g., $Al_2O_3$ nanoparticles or graphene nanoplatelets) into the crucible 230, and may include an automatic feeding system (e.g., feed-screw-based). A gas supply 260 supplies a protection gas such as argon or $CO_2$+$SF_6$, and a thermocouple 270 detects the temperature of the molten metal 240.

The ultrasonic processing system 210 includes an ultrasonic probe 212 (e.g., made of niobium alloy C103), a booster 214 and a transducer 216. The ultrasonic probe 212 ultrasonically cavitates the molten metal 240 and disperses the nanomaterials therein. In one example, the ultrasonic processing system subjects the molten metal 240 (with nanomaterials therein) to intense transient ultrasonic cavitation, at a temperature of about 5000° C. and pressure of about 1000 atm, with strong acoustic streaming (e.g., for about 15 minutes). The molten metal 240 with mixed nanomaterials therein can then be used to form a resulting piece such as the material 100 shown in FIG. 1, with the nanomaterials therein being pushed to grain boundaries (e.g., due to repulsive Van der Waals forces between the nanomaterials and the solidification front), and/or forming micrometer-sized clusters. Mechanical stirring, as shown in FIG. 1, is used to disperse these nanomaterials, and if appropriate, break up clusters and/or shear the nanomaterials as part of the dispersion (e.g., to create secondary phase materials).

Referring to FIG. 3, a mixing apparatus 300 mixes nanomaterials in a liquid metal, in accordance with another example embodiment of the present invention. The apparatus 300 includes a mixing system 310, a resistance heating furnace 320 and a crucible 330 in which a molten metal 340 is heated (shown by way of example as Mg6Zn slurry). The mixing system 310 includes a motor 312, connector 314, shaft 316 and a mixing blade 318. A nanomaterial feeding tube 350 is arranged to feed nanomaterials (e.g., $Al_2O_3$ nanoparticles or graphene nanoplatelets) into the crucible 330, and may include an automatic feeding system (e.g., feed-screw-based). A gas supply 360 supplies a protection gas such as $CO_2$+$SF_6$ or argon, and a thermocouple 370 detects the temperature of the molten metal 340.

Figure 4:
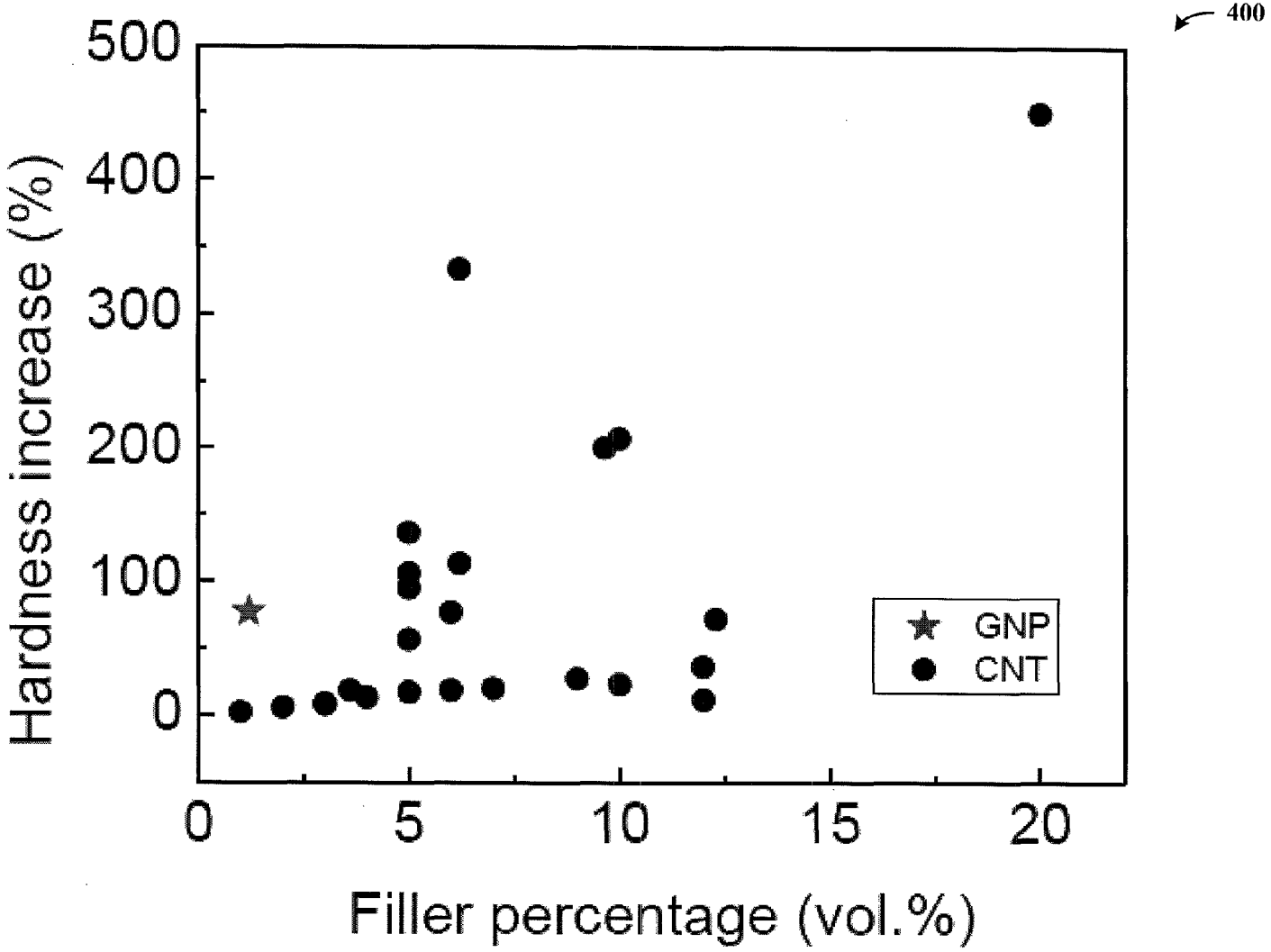
FIG. 4 shows a plot of increased hardness relative to filler percentage, as applicable to various example embodiments of the present invention.
Figure 5:
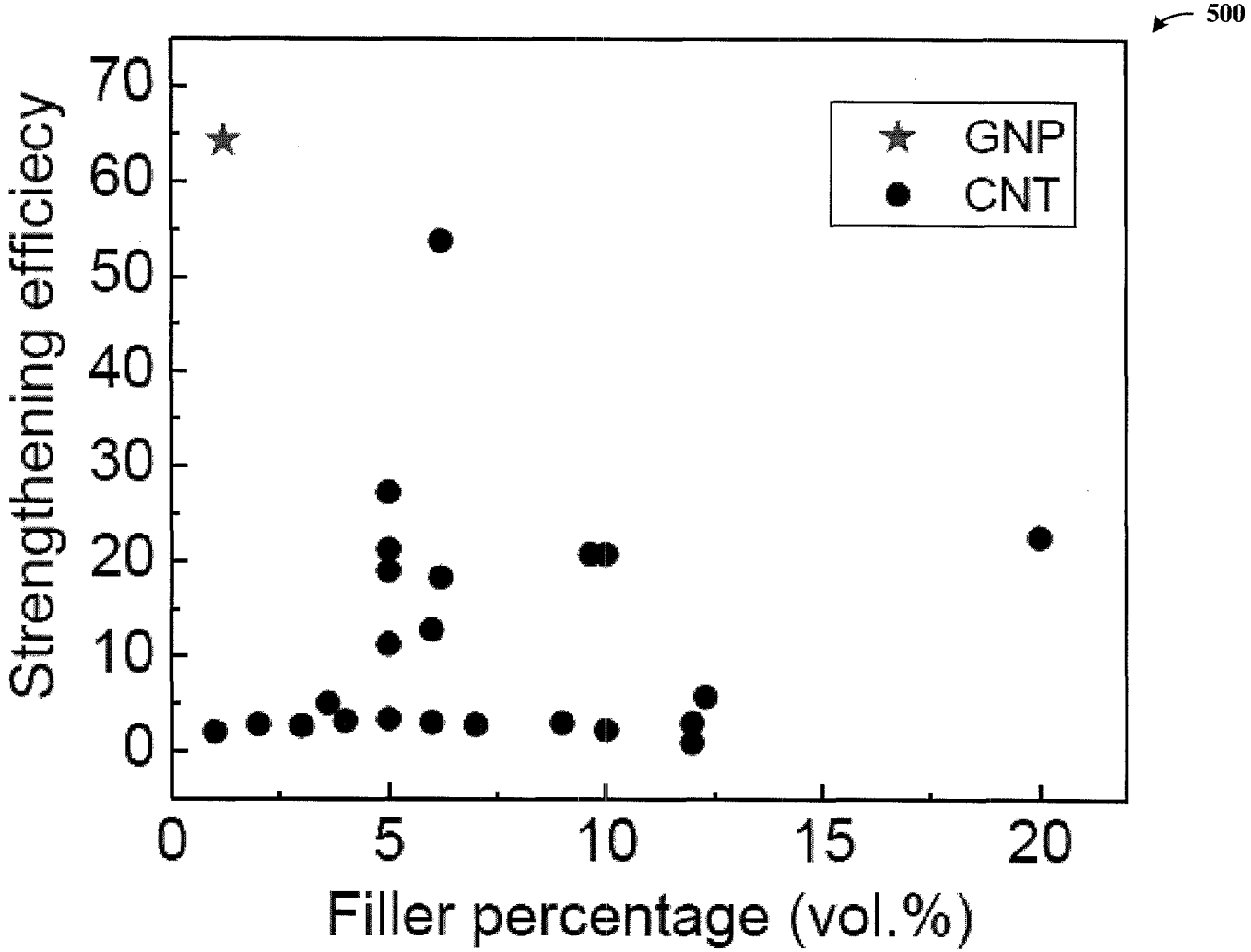
FIG. 5 shows a plot of increased strengthening efficiency relative to filler percentage, as applicable to various example embodiments of the present invention.
Figure 6:
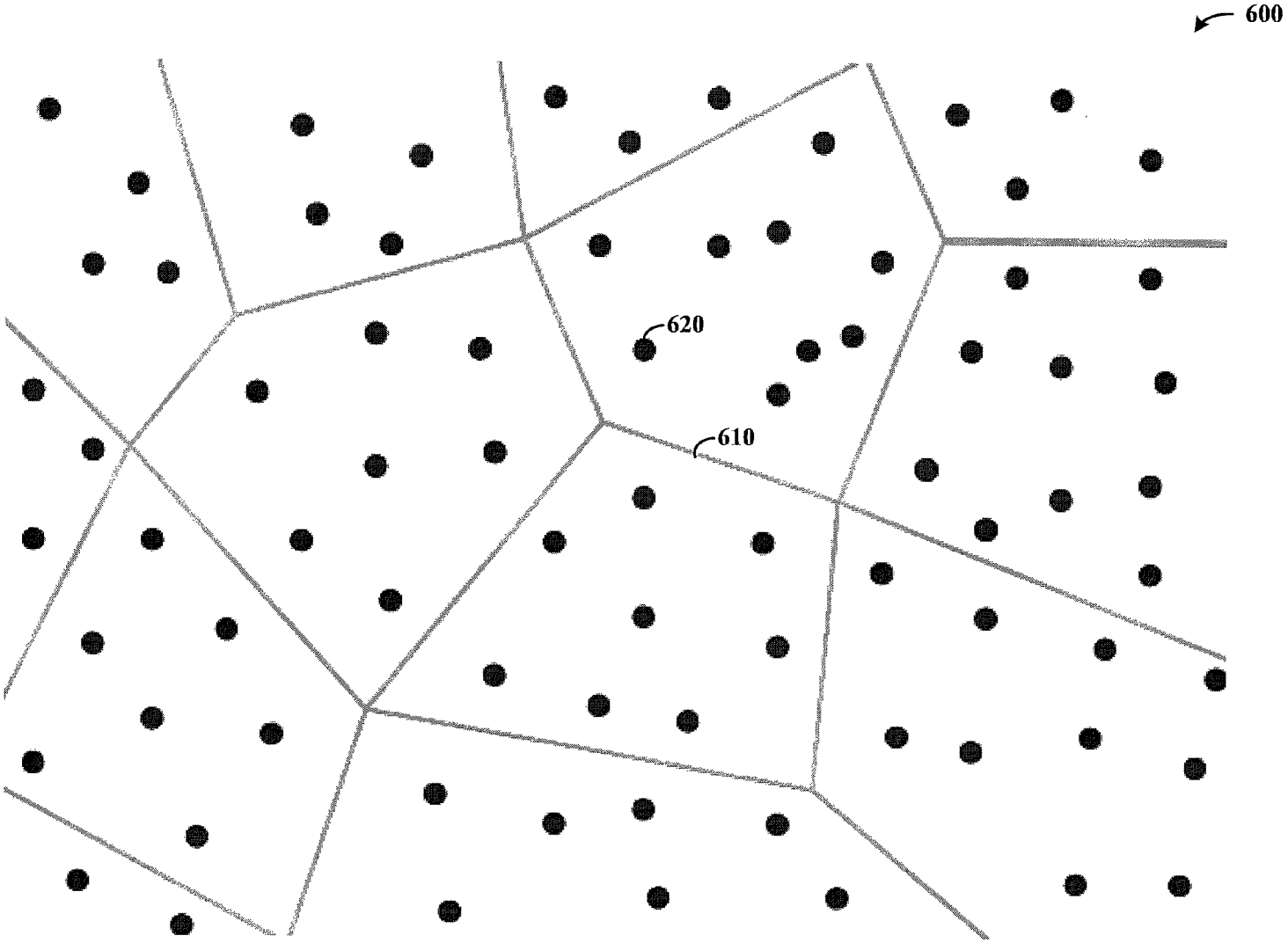
FIG. 6 shows a material having a crystalline structure with nanomaterials dispersed therein, in accordance with another example embodiment of the present invention.

As discussed above, the system(s) as shown in one or all of FIGS. 1-3 can be used to fabricate a variety of different types of materials, using different metal-based materials and nanocomposites, to achieve desirable properties. FIGS. 4 and 5 respectively show plots of increased hardness (by percent) and strengthening efficiency relative to filler volume for graphene nanoplatelets (represented by a star) and carbon nanotubes (represented by circles), in accordance with various embodiments. FIG. 6 shows a material 600 (e.g., material 100 in FIG. 1) having a crystalline structure with nanomaterials dispersed therein, in accordance with another example embodiment of the present invention. The nanomaterials have been dispersed via mechanical stirring while the material 600 is in a viscous state, to disperse the nanomaterials away from grain boundaries (e.g., 610) and/or break up or shear nanoclusters. By way of example, nanomaterial 620 is shown with other nanomaterials as dispersed throughout the grains as shown.

Figure 7:
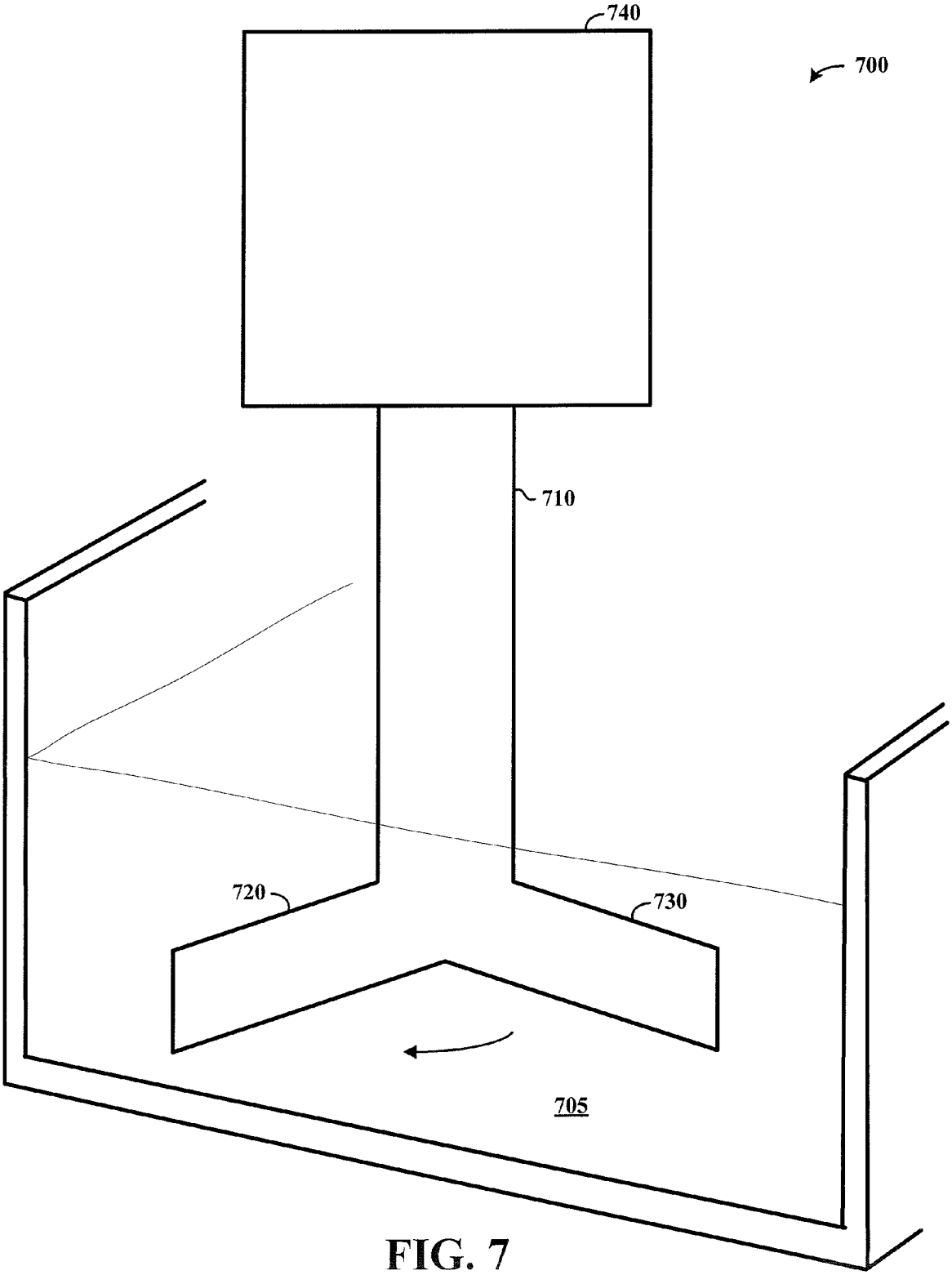
FIG. 7 shows a stirring tool, for use in accordance with one or more example embodiments of the present invention.
Figure 8:
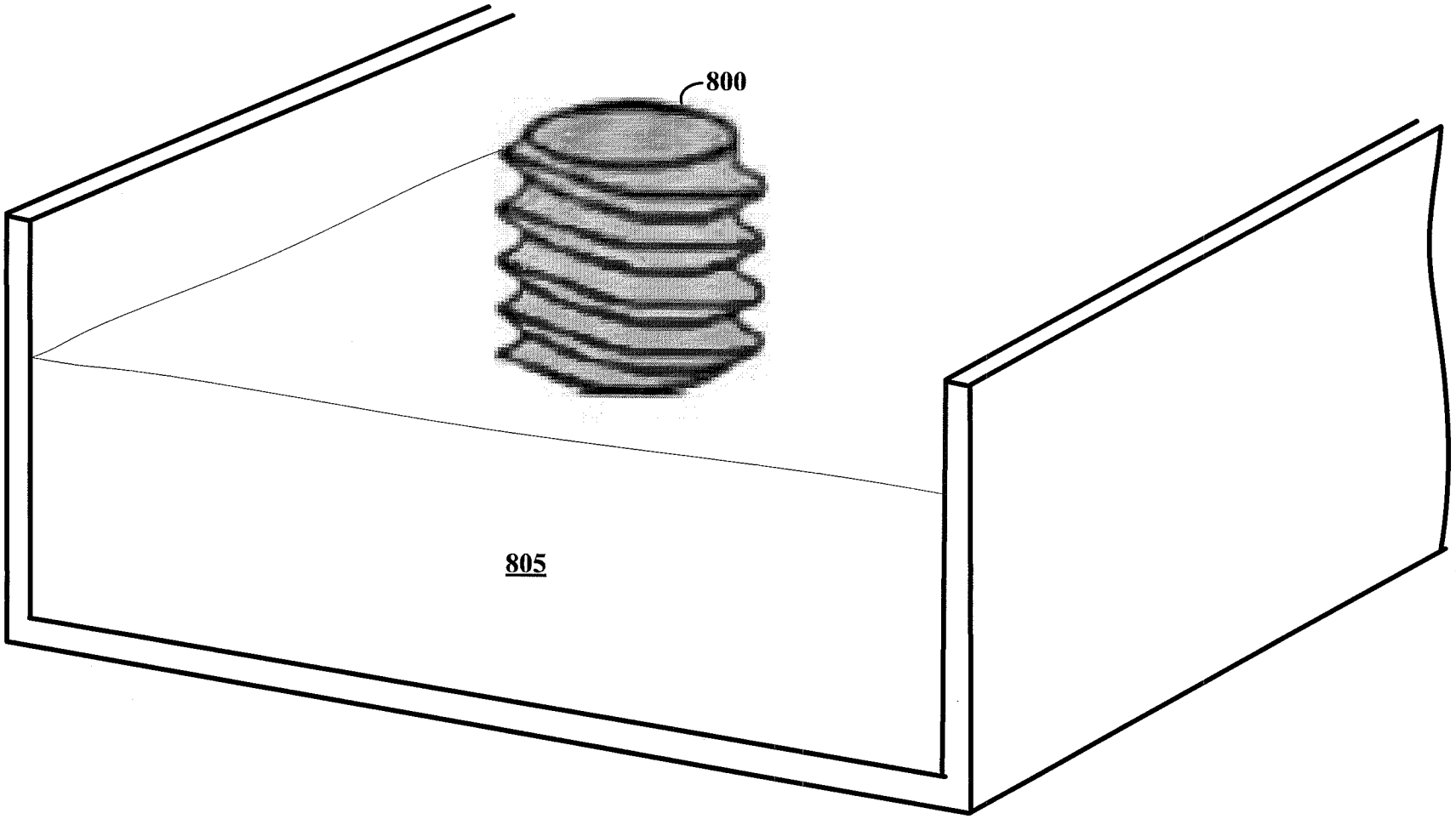
FIG. 8 shows a stirring tool for use in accordance with one or more example embodiments of the present invention.
Figure 9:
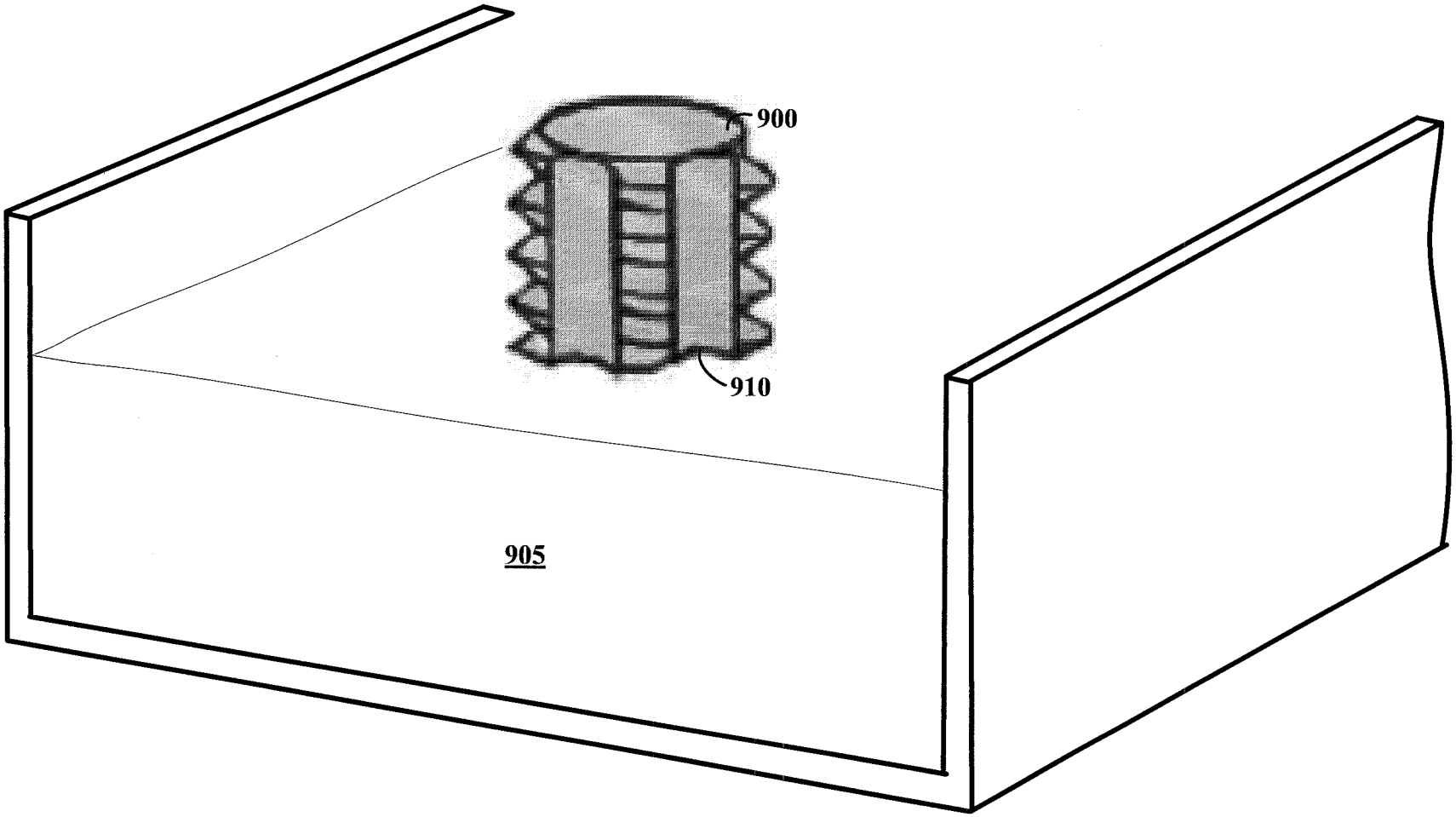
FIG. 9 shows a stirring tool for use in accordance with one or more example embodiments of the present invention.

FIGS. 7-9 show example stirring tools as may be implemented for nanoparticle dispersion via viscous stirring (and maintaining the dispersion via the material viscosity), such as may be implemented with the rotating tool 110 shown in FIG. 1 and/or in various other example embodiments. Beginning with FIG. 7, a stirring tool 700 is shown with a shaft 710 and stirring blades 720 and 730, engaged in a metal-nanoparticle matrix 705. The tool is inserted into a metal-nanomaterial mixture that is above or about at a solidous temperature, and used to stir the mixture. Other geometries may also be used to suit particular embodiments, such as by adding additional blades, changing the geometry of the blades, or using shapes other than blades. The stirring tool 700 may include a motor 740 that drives the tool to stir as shown by the arrow.

FIGS. 8 and 9 show end portions of stirring tools 800 and 900, engaged in stirring nanoparticles in a viscous material in accordance with one or more example embodiments of the present invention. The tools 800 and 900 can be used as the tool 110 as shown in FIG. 1, respectively engaged with metal-nanoparticle matrices 805 and 905. Tool 800 is threaded, and tool 900 is threaded with flutes 910. The size of the tools 800 and 900 may be chosen to suit particular applications, and in some embodiments the tools are about ½" to 1" in diameter, with lengths of about 5-6" or longer. These and other geometries can be used as pins to stir the material 100.

The various tools and approaches as shown in FIGS. 7-9 may be implemented in different embodiments and in different manners, to suit particular applications. Tool geometry, rotation speed, travel speed, depth into the material and material properties can all be set to suit particular applications, and further in accordance with available materials and with cost considerations in mind. For example, a rotation speed of 900 RPM, travel speed of 25 mm/min and a depth of 5 mm may be implemented to suit a particular embodiment.

Figure 10:
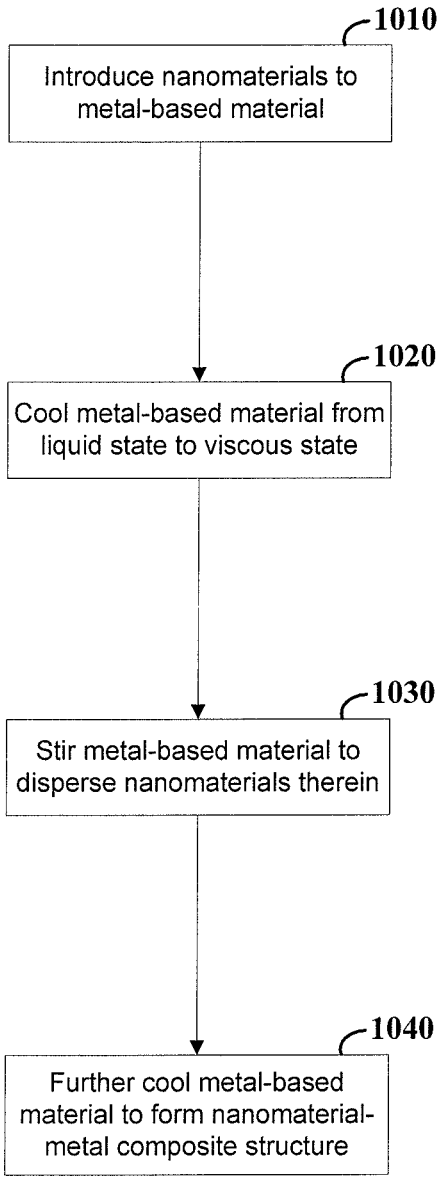
FIG. 10 is a flow diagram for a method of manufacturing a metal-based material, in accordance with another example embodiment of the present invention.

FIG. 10 is a flow diagram for a method of manufacturing a metal-based material, in accordance with another example embodiment of the present invention. At block 1010, nanomaterials are introduced to a metal-based material in a liquid state. This approach may be carried out, for example, by introducing nanomaterials to a liquid metal using an approach such as shown in FIG. 2 or 3 and described above, and can be carried out as the liquid metal cools. The metal-based material with the nanomaterials therein is cooled at block 1020 from the liquid state to a viscous state. At block 1030, the metal-based material (in the viscous state) is stirred to disperse the nanomaterials therein, while using metal-based material in the viscous state to maintain dispersion of the nanomaterials as the metal-based material cools. The stirring may, for example, be carried out to break up clusters of the nanomaterials, and/or to shear the nanomaterials. These approaches maintain the nanomaterials dispersed in the metal, such as shown in FIG. 6, and can be used with limited or substantially no friction-based heating while stirring the metal-based material.

In some embodiments, the process continues at block 1040, in which the metal-based material is further cooled to form a resulting structure with the nanomaterials dispersed therein. For instance, a continuous casting process can be carried out in which a metal ingot is formed with dispersion as shown in FIG. 4, with the nanomaterials dispersed as shown from a pushed state in which the nanomaterials align along grain boundaries. Other structures, such as high-strength wire or bearings, can also be formed from the cooled metal-based material.

Cooling the metal-based material at block 1020 can be carried out in a variety of manners. In some embodiments, the metal-based material is cooled from a temperature in which all the metal-based material is in a liquid state, to a temperature above a solidous temperature of the metal-based material at which at least a portion of the metal-based material is in a liquid state. In another embodiment, the metal-based material is cooled to a temperature about at a solidous temperature of the metal-based material, and in another embodiment, the metal-based material is cooled to a temperature that is within about 30 degrees Celsius below a solidous temperature of the metal-based material.

In various embodiments, the temperature and/or phase of the metal-based material is monitored/detected to determine a point at which the metal-based material has sufficient viscosity to maintain dispersion of nanoparticles, and stirring is effected at this temperature. Once dispersed, the stirring can be terminated while the metal-based material further cools, holding the nanomaterials in the dispersed state.

Figure 11:
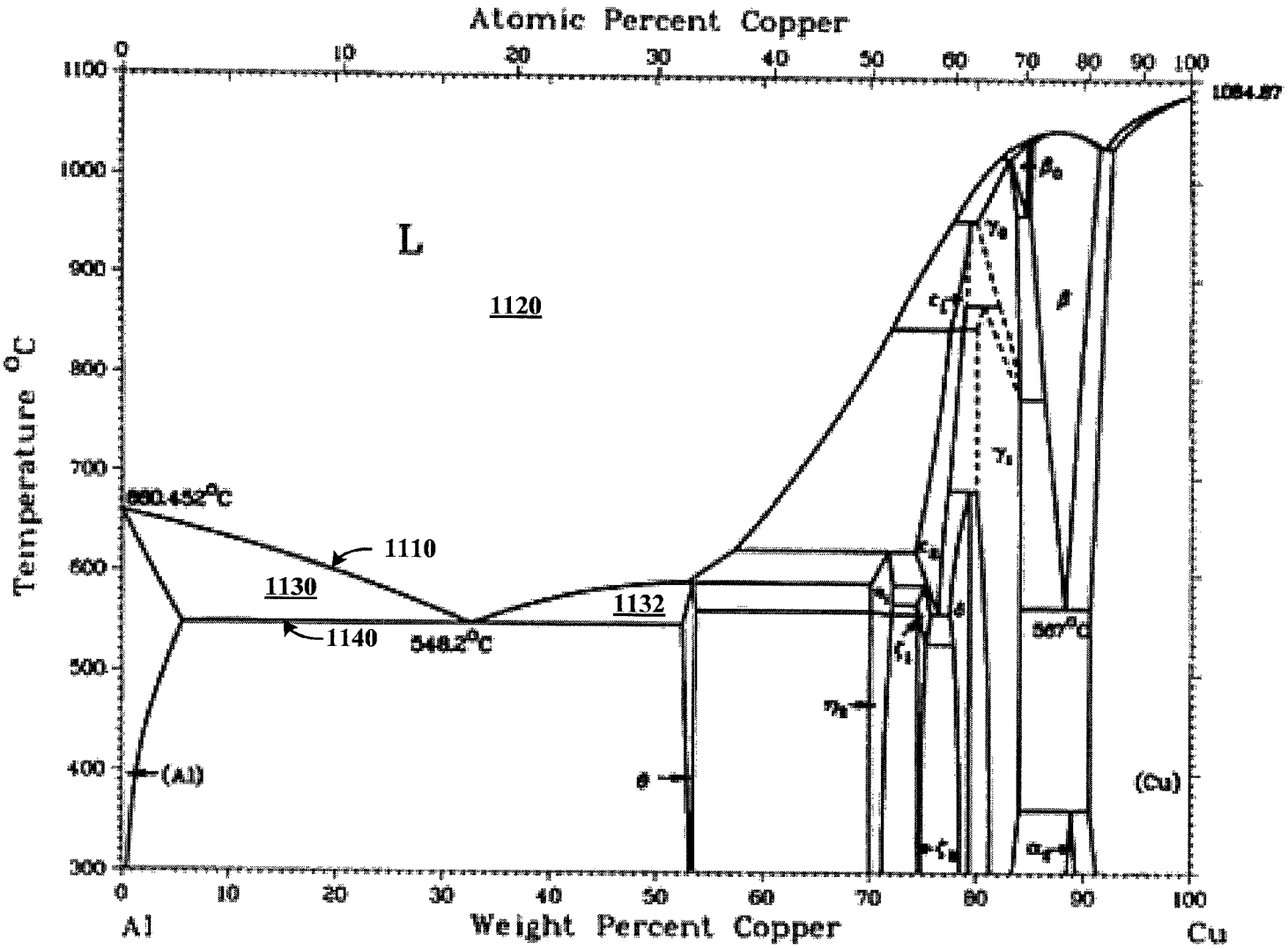
FIG. 11 is a phase diagram for an AlCu material and viscous-phase conditions as may be monitored and otherwise implemented, in accordance with another example embodiment of the present invention.
Figure 12:
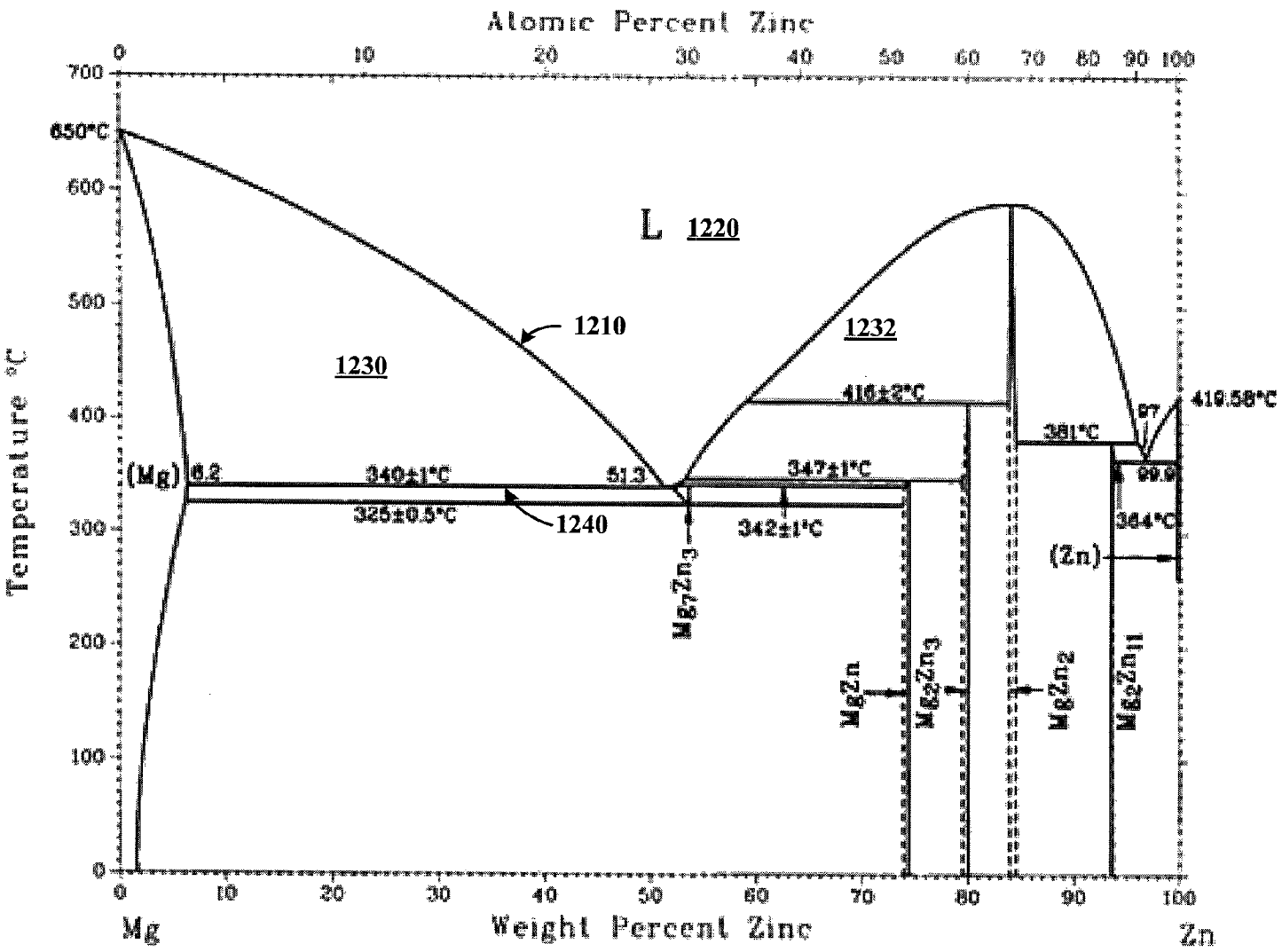
FIG. 12 is a phase diagram for an MgZn material and viscous-phase conditions as may be monitored and otherwise implemented, in accordance with another example embodiment of the present invention.

FIGS. 11 and 12 are phase diagrams respectively for AlCu and MgZn materials, showing viscous-phase conditions as may be monitored and otherwise implemented in accordance with other example embodiments of the present invention. Beginning with FIG. 11, during cooling of an AlCu material, the temperature (and corresponding phase) of the material is monitored using the indicated phase diagram and the liquidous temperature line 1110, based upon the composition of the material. Referring to FIG. 12, liquidous line 1210 is similarly monitored, also based on the composition of the (MgZn) material. Above the liquidous lines (e.g., at 1120 and 1220), the respective materials are in a liquidous form and can be stirred in a viscous state as described herein. Below the liquidous lines (e.g., at 1130, 1132, 1230 and 1232), at least some of the materials are liquidous material, though a solidous temperature as respectively represented at 1140 and

1240. Accordingly, various embodiments are directed to processing AlCu or MgZn in viscous states as represented at one or more of 1120, 1130, 1132 and at 1220, 1230 and 1232, and about at or above the respective solidous temperatures. These embodiments can thus be carried out as AlCu or MgZn is cooled from the liquidous state (e.g., as part of a casting process), and without the addition of any external heat, by monitoring the respective states. In certain embodiments, the monitored state is also used to mitigate tool wear, by ensuring that stirring is carried out at a high enough temperature so as to induce little or no friction at the tool that may affect tool life (e.g., such that the heat of the work is substantially unaffected by the stirring tool).

Various embodiments described above and shown in the figures may be implemented together and/or in other manners. One or more of the items depicted in the drawings/figures herein can also be implemented in a more separated or integrated manner, or removed and/or rendered as inoperable in certain cases, as is useful in accordance with particular applications. For example, a variety of different types of nanomaterials can be incorporated with different types of materials. In addition, one or more approaches to the incorporation of nanomaterials may be implemented in whole or part, with a variety of applications. In view of this and the description herein, those skilled in the art will recognize that many changes may be made thereto without departing from the spirit and scope of the present invention.

What is claimed is:

1. A method comprising:

introducing nanomaterials to a metal-based material that is in a liquid state;

cooling the metal-based material and nanomaterials from the liquid state to a viscous state; and stirring the metal-based material in the viscous state to disperse the nanomaterials therein by physically interacting a tool with the metal-based material in the viscous state, the tool being operable to stir the metal-based material in a solidous state, and using the metal-based material in the viscous state to maintain dispersion of the nanomaterials as the metal-based material cools.

2. The method of claim 1, wherein cooling the metal-based material to a viscous state includes cooling the metal-based material from a temperature in which all the metal-based material is in a liquid state to a temperature above a solidous temperature of the metal-based material at which at least a portion of the metal-based material is in a liquid state.

3. The method of claim 1, wherein cooling the metal-based material to a viscous state includes cooling the metal-based material from a temperature in which all the metal-based material is in a liquid state to a temperature about at a solidous temperature of the metal-based material.

4. The method of claim 1, wherein cooling the metal-based material to a viscous state includes cooling the metal-based material from a temperature in which all the metal-based material is in a liquid state to a temperature within about 30 degrees Celsius below a solidous temperature of the metal-based material.

5. The method of claim 1, wherein stirring the metal-based material includes dispersing the nanomaterials throughout a grain structure away from grain boundaries in the metal-based material.

6. The method of claim 5, wherein cooling the metal-based material to a viscous state includes cooling the metal-based material to a viscous state in which viscous characteristics of the metal-based material maintain the dispersion of the nanomaterials.

7. The method of claim 1, wherein stirring the metal-based material includes dispersing the nanomaterials throughout a grain structure of the metal-based material, from a pushed state in which the nanomaterials are aligned along grain boundaries in the metal-based material by Van der Waals forces between the nanomaterials and a solidification front in the metal-based material, to a dispersed state in which the nanomaterials are dispersed throughout the grains in the metal-based material and away from the grain boundaries.

8. The method of claim 1, further including detecting a temperature of the metal-based material as it cools to the viscous state, and wherein stirring the metal-based material includes stirring the metal-based material based upon the detected temperature indicating that the metal-based material is at a viscosity that mitigates reclustering of the nanomaterials.

9. The method of claim 1, wherein stirring the metal-based material includes stirring the metal-based material as the material cools from the liquid state to the viscous state, dispersing the nanomaterials in the viscous state, and terminating the stirring while further cooling the metal-based material to a solid state composite material including the metal-based material with the nanomaterials dispersed therein.

10. The method of claim 1, wherein stirring the metal-based material includes breaking up clusters of the nanomaterials.

11. The method of claim 1, wherein stirring the metal-based material includes shearing the nanomaterials.

12. The method of claim 1, wherein introducing nanomaterials to a metal-based material in a liquid state includes using ultrasonic waves to manipulate the nanomaterials in the material.

13. The method of claim 1, wherein introducing nanomaterials to a metal-based material in a liquid state includes introducing the nanomaterials to the metal-based material as it cools to the viscous state.

14. The method of claim 1, further including casting the metal-based material as it cools from the viscous state to a solidous temperature and stirring the metal-based material at the solidous temperature.

15. A method comprising:

introducing nanomaterials to a metal-based material that is in a liquid state;

cooling the metal-based material and nanomaterials from the liquid state to a viscous state at which the metal-based material is above its solidous temperature and at least a portion of the metal-based material is in a liquid state;

stirring the metal-based material in the viscous state by physically interacting a tool with the metal-based material to disperse the nanomaterials therein, the tool being operable to stir the metal-based material in a solidous state, and using a metal-based material in the viscous state to maintain dispersion of the nanomaterials as the metal-based material cools.

16. The method of claim 15, wherein stirring the metal-based material in the viscous state includes stirring the metal-based material while providing substantially no friction-based heating of the metal-based material via the stirring.

17. The method of claim 15, further including, before cooling the metal-based material and nanomaterials, heating the metal-based material with an external heat source.

18. The method of claim 15, wherein stirring the metal-based material in the viscous state includes using the tool to disperse the nanomaterials away from grain boundaries within the metal-based material while the material is in the viscous state.

19. The method of claim 15, wherein stirring the metal-based material includes stirring the metal-based material in a partially-solidified state, further including casting the metal-based material as it cools from the viscous state to a solid state.

* * * * *